US006416196B1

(12) United States Patent
Lemarchand et al.

(10) Patent No.: US 6,416,196 B1
(45) Date of Patent: Jul. 9, 2002

(54) COMMAND KEY WITH INTEGRATED ILLUMINATION AND PROCESS FOR THE MANUFACTURE OF SAID KEY

(75) Inventors: Joël Lemarchand, Evreux; Martial Cahagne, deceased, late of Evreux, both of (FR), by Stephane Michel-Grosjean, legal representative

(73) Assignee: Qwertec, Evreux (FR)

( * ) Notice: Subject to any disclaimer, the term of this patent is extended or adjusted under 35 U.S.C. 154(b) by 0 days.

(21) Appl. No.: 09/363,720

(22) Filed: Jul. 29, 1999

(30) Foreign Application Priority Data

Aug. 18, 1998 (FR) ..... 98 10498

(51) Int. Cl.[7] ..... H05B 33/00; H01H 9/00

(52) U.S. Cl. ..... 362/84; 362/23; 362/85; 40/544; 200/314

(58) Field of Search ..... 362/23, 29, 30, 362/85, 84; 341/22; 200/313, 314; 40/544

(56) References Cited

U.S. PATENT DOCUMENTS 3,934,247 A * 1/1976 Mueller ..... 341/22
4,806,908 A 2/1989 Krupnick ..... 341/22
5,510,782 A * 4/1996 Norris et al. ..... 341/22
5,568,367 A * 10/1996 Park ..... 362/85
5,797,482 A * 8/1998 LaPointe et al. ..... 200/314
5,876,106 A * 3/1999 Kordecki ..... 362/29

FOREIGN PATENT DOCUMENTS

| | | |
|---|---|---|
| DE | 21 13 902 | of 1977 |
| EP | 0 134 979 | 10/1998 |
| EP | 0 847 066 | 10/1998 |

* cited by examiner

*Primary Examiner*—Alan Cariaso
(74) *Attorney, Agent, or Firm*—Greenberg Traurig, LLP

(57) ABSTRACT

The key comprises a raised pressure and command part (1), carrying at least one character label, and means of illuminating the character label. The means of illumination comprise a light-emitting illumination layer (10) located in the base of the raised pressure and command part (1) and extended laterally either by electrical contacts or by electrical connection tracks (12, 13).

To manufacture the key, the illumination layer is put in place after having printed the character by serigraphy onto a film which has been stamped out.

The invention is used in the production of keypads.

10 Claims, 3 Drawing Sheets

COMMAND KEY WITH INTEGRATED ILLUMINATION AND PROCESS FOR THE MANUFACTURE OF SAID KEY

The invention relates to a command key such as is found in particular on the keypads of, for example, mobile telephones, and more particularly a command key with integrated illumination comprising a raised pressure and command part, bearing at least one character label, and means of illuminating the character label. In the case of a keypad, it is necessary to consider a plurality of keys rather than a single one.

For the manufacture of a key, the pressure pat may be moulded out of translucent material, then coated with a layer of semi-transparent paint and a layer of opaque paint and finally the character label is produced, for example, by laser etching.

The pressure part may likewise be moulded by twin injection of a material intended to constitute the body of the key and another material intended to produce the character label.

It is also possible to stamp a transparent thermoplastic film upon which the character label is produced by serigraphy using an opaque ink and a semi-transparent ink.

To illuminate the character label, light-emitting diodes (LEDs) are most frequently used, the disadvantage of these being that they consume a lot of electrical energy and, for this reason, reduce the life of the mobile telephone's battery, to take that example.

In order to resolve this problem, a light-emitting illumination layer may be used. EP 847 066 presents a command key of the type described above, which has a light-emitting illumination layer. However, this light-emitting layer, carried on a substrate which is separate from the pressure and command part, produces inadequate illumination.

DE 26 13 902 likewise presents a switch with a button and, within the latter, a light-emitting illumination layer whose two electrodes are connected to an electrical supply circuit via a spring and a connecting pin. Owing to the position of the layer, the illumination is more effective, but the electrical connectors supplying the layer are cumbersome.

The present invention proposes to provide illumination for a command key using a light-emitting layer, in a neat and effective manner.

To this end, the invention relates to a command key with integrated illumination comprising a raised pressure and command part, bearing at least one character label, and means of illuminating the character label comprising a light-emitting illumination layer, characterised by the fact that the illumination layer extends along the base of the pressure and command part and is continued laterally either by electrical contacts or by electrical connection tracks.

Since the illumination layer extends along the base of the pressure part, it is located in the immediate vicinity of the character label which considerably limits losses in illumination. In addition, the lateral extensions of the illumination layer, via electrical contacts or via conducting tracks, make it possible to take an electrical supply to the illumination layer without adding to the space taken up by the key.

The invention also relates to a process for the manufacture of a key as described above, in which a film is taken, upon which at least one character label is produced by serigraphy; the said film is stamped to form the raised pressure and command part and is characterised by the fact that a light-emitting illumination layer is disposed within the stamped part.

In a particular embodiment, prior to stamping, the illumination layer is deposited onto a zone of the said film, intended to form the base of the stamped part, and the illumination layer is extended laterally by means of electrical conductors.

In another embodiment, another film is taken, onto which is deposited the illumination layer which is laterally extended by means of electrical conductors, a portion of film carrying the illumination layer with an extension supporting the electrical conductors is cut out from the said other film, and the said portion of film is placed inside of the stamped part.

As a result there is no risk of damaging the illumination layer during stamping.

The invention will be more easily understood with the aid of the following description of different embodiments of the key of the invention and of corresponding different embodiments of the manufacturing process for that key, with reference to the appended drawing in which.

Figure 1:
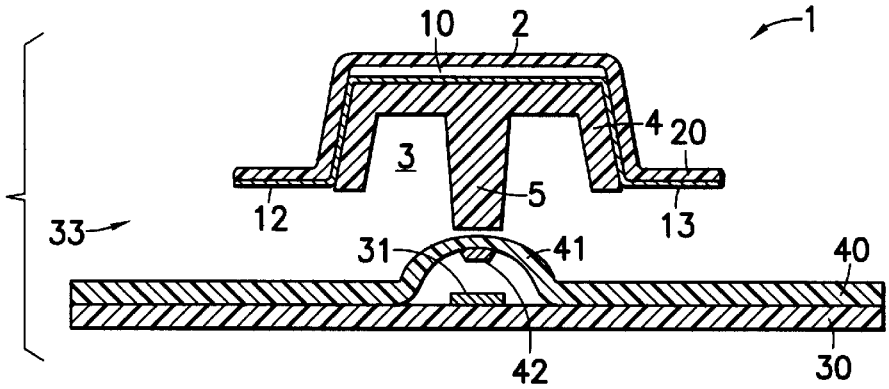
FIG. 1 shows a lateral cross-sectional view of the key according to a first embodiment.
Figure 2:
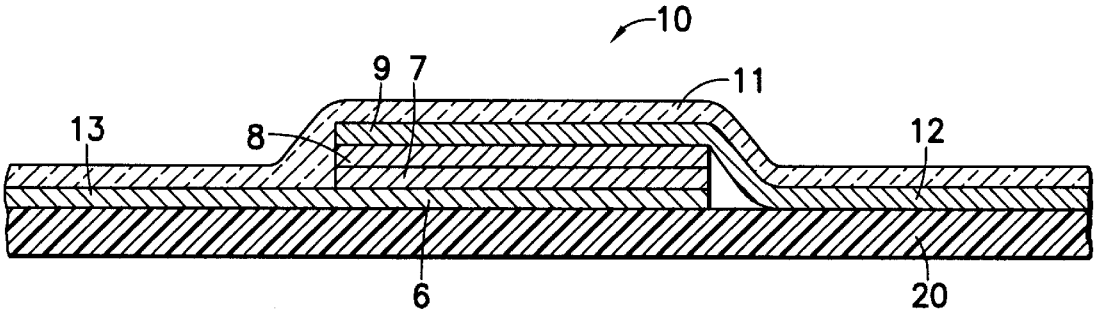
FIG. 2 shows a lateral cross-sectional view of an illumination layer for the key in FIG. 1.
Figure 3:
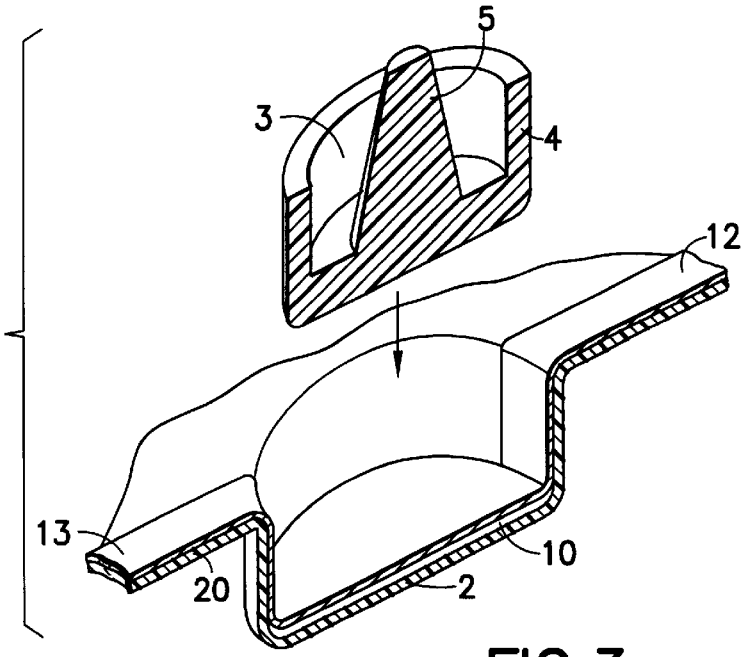
FIG. 3 shows a cross-sectional and exploded perspective view of a pressure and command part of the key in FIG. 1.

The command key 50 shown in FIG. 1, is part of a mobile telephone keypad comprising a plurality of other like keys. In the interests of clarity, the key 50 alone will now be described.

The key 50 comprises a raised pressure and command part 1, separated from a substrate 30.

The pressure and command part 1 consists of part stamped from a transparent thermoplastic film 20, extending on one side 33 of the substrate 30, in a plane which is generally parallel to the substrate 30, at a fixed distance from the latter. The pressure and command part 1 has a cut-out 3 open on the side of the substrate 30 and a base 2. A character label, in this case a number, is printed by serigraphy onto the base 2, inside the cut-out 3, in semi-transparent ink, in this case white, with a background in opaque ink, in this case black.

The cutout 3 contains an actuating unit 4, integral with the pressure and command part 1, and provided with a pressure finger 5 which projects from the cut-out 3, and is designed to work in conjunction with a contact or actuating dome 41, which is deformable and flexible.

The pressure and command part 1 moves in a direction generally perpendicular to the plane in which the substrate 30 extends, between a non-operative position and a command position, explained hereinunder.

The substrate 30 is a thermoplastic film carrying conducting tracks [not illustrated], and, on the side 33, another thermoplastic film 40 from which the contact dome 41 is stamped.

Two electrical contacts 42, 31, facing each other, are carried on the inside surface of the dome 41 and on the substrate 30 respectively. The contact 41 [sic] consists of a conducting bonding pad and the contact 31 comprises two portions of contact conducting track connected to the conducting tracks of the substrate 30 but not connected to each other.

In the non-operative position, the pressure finger 5 is in contact with the peak of the dome 41 and the two electrical contacts 42, 31 are separated from each other. In order to dial the number serigraphically printed onto the key 50, a mobile telephone user must press on the pressure and command part 1 with a finger, moving said part from its non-operative position to its command position. In command position, the pressure finger 5 depresses and flexes the dome 41 with its free end, and the two electrical contacts 42, 31 come into contact with each other. The bonding pad 42 then connects the two portions of the contact track 31, which generates an electrical command signal to dial the number printed serigraphically onto the key 40 [sic]. When the user withdraws his finger, the pressure part 1 and the contact dome 41 move back to the non-operative position by a spring return movement.

The base 2 supports a light-emitting illumination layer 10, located inside the pressure and command part 1. This illumination layer 10 consists, in succession, of:

- a base layer 6 of transparent conducting ink, in this case ITO (Indium Tin Oxide), extending over the film 20,
- a dielectric layer 7,
- a phosphorescent layer 8 of ink containing phosphorous and
- a top conducting layer 9, in this case carbon.

The thicknesses of the successive layers 6, 7, 8 and 9 are in this case substantially equal to ten, twenty, thirty and twenty micrometers respectively. A sealing layer 11 of transparent lacquer, covers the illumination layer 10.

The illumination layer 10 thus comprises two conducting layers 6, 9 facing each other and separated from each other by the dielectric layer 7 and the phosphorescent layer 8 These two conducting layers 6, 9 act as capacitor armatures and each extends laterally via a conducting track 13, 12 connecting to an electrical supply [not illustrated] extending, from the base 2, to the interior lateral walls of the pressure and command part 1 and, outside part 1, to the back of the film 20. The "back" of the film 20 means the side of this film which is not visible to the user, located on the same side as the substrate 30.

In operation, when the armatures 6 and 9 are supplied with electric current, they create an electrical field between each other as in a capacitor. Under the action of this field, the phosphorescent layer 8 emits light which illuminates the character label serigraphed onto the key 50.

Following the structural description of the command key 50, its manufacturing process will now be described.

A transparent thermoplastic film 20 is taken. Onto the back of the film 20, the character label is printed by serigraphy, in semi-transparent white ink, on a zone designed to constitute the base 2, together with a background, in opaque black ink.

Onto the back of the film 20, on the area intended to form the inner surface of the base 2, in succession and using serigraphy, transparent conducting ink is deposited, then a dielectric substance, then ink containing phosphorous, then carbon is deposited and a sealing lacquer, in order to deposit the light-emitting illumination layer 10 with its sealing coat 11. When depositing the illumination layer 10, the armatures 6 and 9 (the deposit of conducting ink and the deposit of carbon) are made to run over laterally beyond the zone intended to form the base 2, in order to extend the illumination layer 10 laterally via electrical conductors, conducting tracks 13 and 12, which are electrically connected to the electrical supply.

The film 20 is then stamped to give it the shape of the pressure and command part 1, such that the illumination layer 10 extends over the base 2 of the stamped part 1. It is stressed that, during the stamping process, the conducting tracks 12, 13 are bent, but not the illumination layer 10.

After forming the pressure part 1, a translucent thermoplastic material is injected into it in order to form the actuating unit 4.

A film 40 of polycarbonate is taken, and onto it is deposited a pellet of conducting ink constituting the electrical contact 42. Then the film 40 is stamped to form the contact dome 41.

A polycarbonate film 30 is taken, onto which are printed by serigraphy conducting tracks and the electrical contact 31, using a conducting ink.

The film 40 is extended against the film 30 and these two films are united by adhesion, positioning the electrical contacts 31, 42 facing each other.

Finally, the film 20 is fixed to the unit consisting of the two films 30, 40, by positioning the stamped part 1 in line with the dome 41 and by inserting between the film 20 and the unit of the two films 30, 40 adhesive pellets [not illustrated] forming spacers, intended to hold the pressure and command part 1 apart from the substrate 30.

Figure 4:
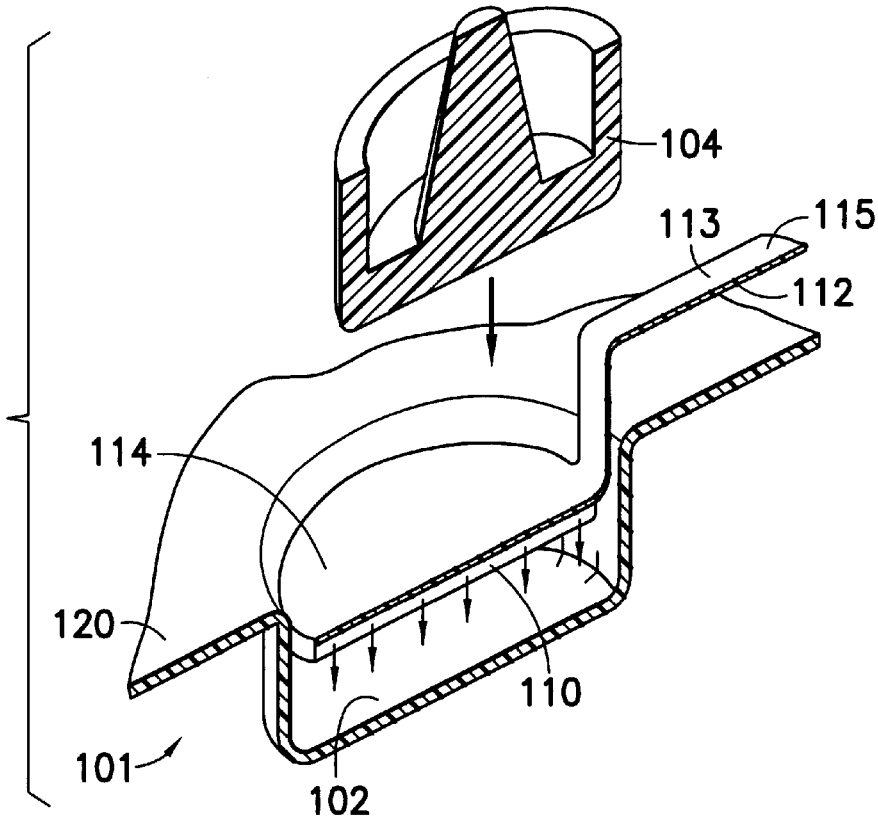
FIG. 4 shows a cross-sectional and exploded perspective view of a pressure and command part of the key, according to a second embodiment.
Figure 5:
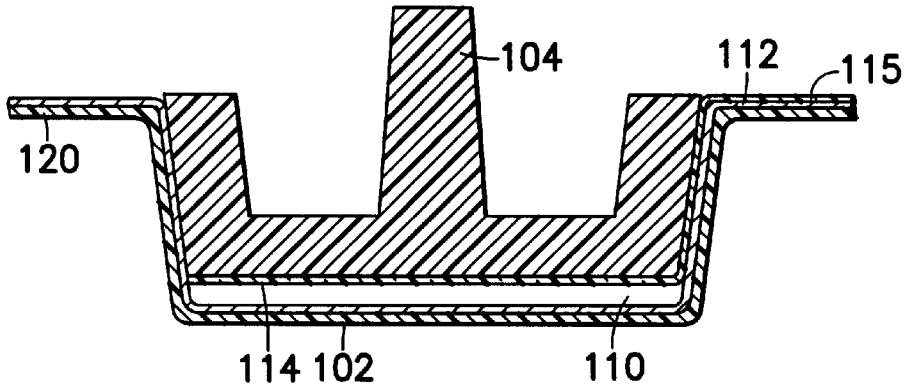
FIG. 5 shows a lateral cross-sectional view of the pressure and command part of the key in FIG. 4.
Figure 6:
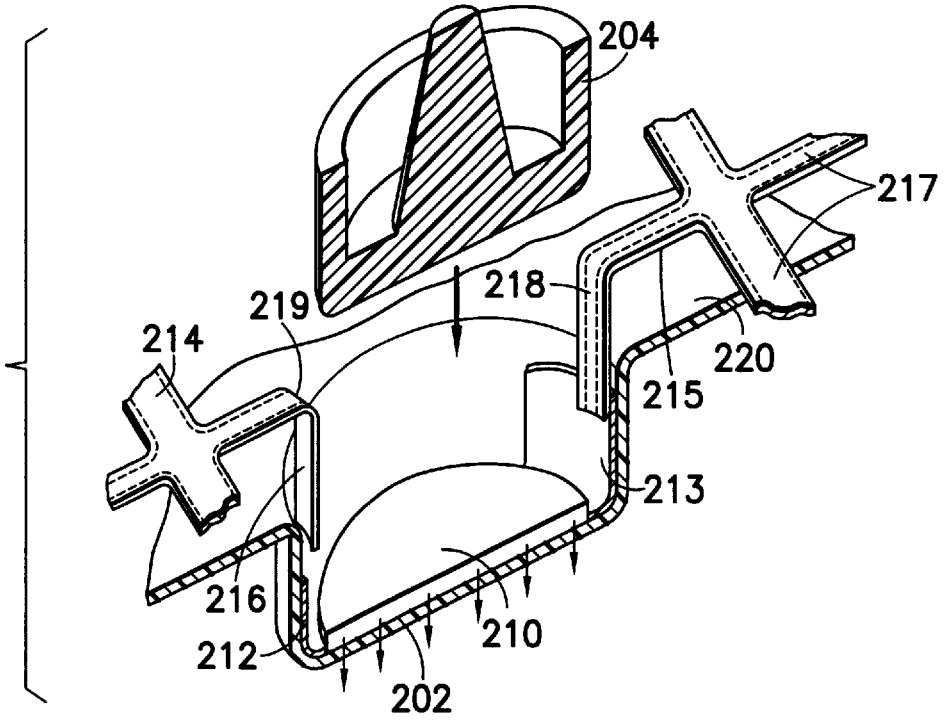
FIG. 6 shows a cross-sectional and exploded perspective view of a pressure and command part of the key according to a third embodiment and FIG. 7 shows a lateral cross-sectional view of the pressure and command part of the key in FIG. 6.
Figure 7:
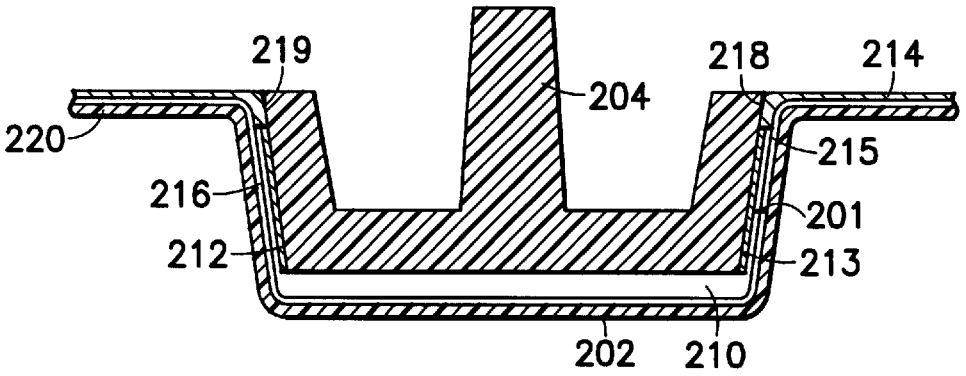

A second embodiment of the command key, represented in FIGS. 4 and 5, differs from the preceding description only in what will now be described. In the interests of clarity, the parts in this second embodiment bear the references of the corresponding parts of the first embodiment described above, augmented by one hundred.

The command key comprises a raised pressure and command part 101, separated from a substrate.

The pressure and command part 101, stamped out of a transparent thermoplastic film 120, supports a character label and contains an actuating unit 104.

A portion of thermoplastic film 114, with dimensions substantially equal to those of the base 102 of the pressure and command part 101, and carrying, on one side, a light-emitting illumination layer 110, is placed inside the pressure and command part 101, in the immediate vicinity of the base 102. The illumination layer 110 is turned towards the base 102. A strip of film 115 extends the portion of film 114 laterally and carries conducting tracks 112, 113 connected to an electrical supply, which themselves laterally extend the illumination layer 110. This strip of film 115 extends, from the base 102, against the internal lateral walls of the pressure part 101 and, outside this part 101, against the back of the film 120.

The manufacturing process for the key described above will now be explained. In the interests of clarity, only the stages of this second embodiment of the manufacturing process which differ from those of the first embodiment described, will now be explained.

A transparent thermoplastic film 120 is taken, onto which the character label is printed, using serigraphy, in semi-transparent ink, together with a background in opaque ink.

Another thermoplastic film is taken, onto which is deposited the light-emitting illumination layer 110 on one side, using serigraphy. The armatures of the illumination layer 110 are made to run over laterally, in order to extend it laterally by electrical conductors, the connection tracks 112, 113, which are connected to the electrical supply.

From this other film, the portion of film 114 carrying the illumination layer 110, is cut out, with substantially the same dimensions as the base 102 of the pressure part 101, with an extension, the strip of film 115, carrying the conducting tracks 112, 113.

After it has been cut out, the portion of film 114, together with its extension 115, is placed against the back of the film 120, positioning the illumination layer 110 against a zone intended to form the inside surface of the base 102. Then the film 120 and the portion of film 114 together with its extension 115 are stamped out simultaneously, in order to form the pressure and command part 101. During the stamping out procedure, the conducting tracks 112, 113 are bent, (but not the illumination layer 110) and the illumination layer 110 is placed inside the stamped out part 101, against the base 102.

A third embodiment of the key differs from the first embodiment described only in what Will now be described. In the interests of clarity, the parts of this third embodiment bear the references of the corresponding parts of the first embodiment, augmented by two hundred.

The command key comprises a raised pressure and command part 201, separated from a substrate.

The pressure and command part 201, stamped out from a transparent thermoplastic film 220, supports a character label and contains an actuating unit 204.

A light-emitting illumination layer 210 is located inside the pressure and command part 201, on its base 202.

Two electrical contacts 212, 213 extend the illumination layer 210 laterally. These two electrical contacts 212, 213 consist of a deposit of conducting ink and a deposit of carbon respectively. Each contact 212, 213 extends laterally one of the armatures of the illumination layer 210, and stretches over an area of the internal lateral wall of the pressure and command part 201.

A contact retrieval film 214 connected to an electrical supply, is added to the back of the film 220 (on the substrate side). This film 214 comprises strips of film 217, carrying conducting tracks 215, 216 to retrieve contact, with two contact retrieval tabs 218, 219 each carrying the end part of a conducting track 215, 216. The tabs 218, 219 are bent and extend at their free end against the internal lateral wall of the pressure and command part 201, the end parts of the contact retrieval tracks 215, 216 being in electrical contact with the electrical contacts 212, 213 respectively.

Instead of connecting the two contacts to the electrical supply, it would also be possible to envisage connecting one only of the two contacts to the electrical supply and earthing the other contact.

The manufacturing process for the command key described above will now be described. In the interests of clarity, only the stages of this third embodiment of the manufacturing process which differ from the first embodiment described will now be explained.

A transparent thermoplastic support film 220 is taken, onto which the character label is printed serigraphically in semi-transparent ink, together with a background in opaque ink.

On the back of the film 220, onto an area intended to form the inside surface of the base 202 of the pressure and command part 201, the illumination layer 210 is deposited by serigraphy. The armatures of this illumination layer 210 are made to run over laterally, in order to extend it laterally, by means of electrical conductors, the electrical contacts 212, 213.

Another thermoplastic film is taken, onto which are printed the contact retrieval conducting tracks 215, 216. From this other film, strips 217 are cut out carrying conducting tracks 215, 216 and the two tabs 218, 219 carrying the end parts of the conducting tracks 215, 216, in order to manufacture the contact retrieval film 214.

The contact retrieval film 214 is placed against the back of the film 220, turning the conducting tracks 215, 216 towards the film 220 and putting the free end parts of the contact retrieval tabs 218, 219 into contact with the electrical contacts 212, 213. Then the contact retrieval film 214 and the film 220 are stamped out simultaneously in order to form the pressure part 201, by bending the tabs 218, 219, but not the illumination layer 210. Finally, the contact retrieval tracks 215, 216 are connected to the electrical supply.

To manufacture the illumination layer, instead of depositing first the dielectric layer then the phosphorescent layer, it would be possible first to deposit the phosphorescent layer, then the dielectric layer, thus reversing the order of succession of these two layers.

What is claimed is:

1. Command key with integrated illumination comprising a raised pressure and command part (1; 101; 201; 301) having a bottom (2; 102), carrying at least one character label, and means for illuminating the character label comprising a light-emitting illumination layer (10; 110; 210; 310), characterized in that the light-emitting illuminating layer (10; 110; 210; 310) extends along the bottom of the pressure and command part (1; 101; 210; 310) and is extended laterally either by electrical contacts (212, 213) or by electrical connection tracks (12, 13; 112, 113; 312, 313).

2. Key according to claim 1, wherein the light-emitting illumination layer (10) comprises two conducting layers (6, 9) forming armatures, facing each other and separated from each other by a dielectric layer (7) and a phosphorescent layer (8).

3. Key according to claim 1, wherein the bottom (2; 102) of the pressure and command part (1; 101) carries the illumination layer (10; 110).

4. Key according to claim 1, wherein a portion of film (114), placed on the inside of the pressure and command part (101), carries the illumination layer (10; 110).

5. Process for manufacturing a key according to claim 1, wherein a film (20; 120; 220) is taken onto which is printed serigraphically at least one character label, and the said film (20; 120; 220) is stamped to form the raised pressure and command part (1; 101; 201), characterized by the fact that inside the stamped part (1; 101; 201) is placed a light-emitting illumination layer (10, 110; 210), and wherein, prior to stamping, the illumination layer (10; 210) is deposited on an area of the said film (20, 220) intended to form the bottom (2; 202) of the stamped part (1; 201), and the illumination layer (10; 210) is extended laterally by electrical conductors (12, 13; 212, 213).

6. Process for manufacturing a key according to claim 1, wherein a film (20; 120; 220) is taken onto which is printed serigraphically at least one character label, and the said film (20; 120; 220) is stamped to form the raised pressure and command part (1; 101; 201), characterized by the fact that inside the stamped part (1; 101; 201) is placed a light-emitting illumination layer (10; 110; 210), and wherein another film is taken, onto which is deposited the illumination layer (110) which is extended laterally by electrical conductors (112, 113), from the said other film is cut out a portion of film (114) carrying the illumination layer with an extension (115) carrying the electrical conductors (112, 113) and the said portion of film (114) is placed inside the stamped part (101).

7. Process according to claim 6, wherein the said potion of film (114) carrying the illumination layer (110) is placed against an area of the said film (120) intended to form the bottom of the pressure and command part(101), and the said film (120) and the said portion of film (114) are stamped in order to from the pressure and command part (101).

8. Process for manufacturing a key according to claim 1, wherein a film (20; 120; 220) is taken onto which is printed serigraphically at least one character label, and the said film (20; 120; 220) is stamped to form the raised pressure and command part (1; 101; 201), characterized by the fact that inside the stamped part (1; 101; 201) is placed a light-emitting illumination layer (10; 110; 210), and wherein the illumination layer (210) is extended laterally by electrical contacts (212, 213), and a contact retrieval film (214) is manufactured, supporting contact retrieval tracks (215, 216) which are placed in contact with the electrical contacts(212, 213).

9. Process according to one of claims 5, 6, or 8 wherein the illuminations layer (10; 110) is extended laterally by electrical connections tracks (12,13; 112, 113).

10. Process according to one of claims 5, 6, or 8, wherein, in order to form the illumination layer (10), two conducting layers (6, 9) are deposited and between these two layers (6, 9), a dielectric layer (7) and a light-emitting layer (8) are deposited, whilst making the conducting layers (6, 9) run over laterally in order to from electrical conductors (12, 13).

* * * * *